US007566046B2

(12) United States Patent
Muhr et al.

(10) Patent No.: US 7,566,046 B2
(45) **Date of Patent: *Jul. 28, 2009**

(54) VALVE SPRING PLATE WITH TWO SUPPORTING TONGUES

(75) Inventors: Thomas Muhr, Attendorn (DE); Jochen Asbeck, Attendorn (DE); Vladimir Kobelev, Attendorn (DE); Karsten Westerhoff, Wetter (DE); Jörg Dieter Brecht, Olpe (DE); Andreas Hees, Norken (DE)

(73) Assignee: Muhr und Bender KG, Attendorn (DE)

( * ) Notice: Subject to any disclaimer, the term of this patent is extended or adjusted under 35 U.S.C. 154(b) by 215 days.

This patent is subject to a terminal disclaimer.

(21) Appl. No.: 11/478,881

(22) Filed: Jun. 30, 2006

(65) Prior Publication Data

US 2007/0007485 A1 Jan. 11, 2007

(30) Foreign Application Priority Data

Jun. 30, 2005 (DE) ..... 10 2005 031 089

(51) Int. Cl.
*F01L 3/10* (2006.01)

(52) U.S. Cl. ..... 251/337; 123/188.13

(58) Field of Classification Search ..... 251/337; 123/188.12, 188.13, 188.3
See application file for complete search history.

(56) References Cited

U.S. PATENT DOCUMENTS 5,293,848 A * 3/1994 Rich et al. ..... 123/90.67

* cited by examiner

*Primary Examiner*—John K Fristoe, Jr.

(57) ABSTRACT

A spring plate for a valve spring of an internal combustion engine, which spring plate can be connected directly to the valve stem of a charge changing valve while engaging an annular groove in the valve stem. An annular disc is arranged on the valve spring and two supporting tongues which are directed radially inwardly from the annular disc and whose inner ends, in a plan view of the spring plate, comprise recesses for engaging an annular groove.

28 Claims, 10 Drawing Sheets

VALVE SPRING PLATE WITH TWO SUPPORTING TONGUES

FIELD OF THE INVENTION

The invention relates to a spring plate for a valve spring of an internal combustion engine. The spring plate can be connected directly to the valve stem of a charge changing valve while engaging an annular groove in the valve stem. Spring plates of this type hold and centre the valve springs of charge changing valves which are arranged concentrically relative to the valve stem and which are supported more particularly by a second spring plate at the cylinder head. The valve is actuated by pressure forces being applied to the free end of the valve stem. The free end projects beyond the spring plate, by cams, rocker arms or valve levers. Between the actuating elements and the spring plate it is possible to place offsetting devices.

Spring plates of the above type are known from U.S. Pat. Nos. 3,612,016; 5,343,835 and 5,381,765 for example.

OBJECT OF THE INVENTION

It is the object of the present invention to provide a short and stiff spring plate which has been improved as compared to the prior art devices, as well as an assembly consisting of such a spring plate and a charge changing valve.

Furthermore, it is the objective to propose a device for mounting such an assembly.

SUMMARY OF THE INVENTION

The objective is achieved by providing a spring plate for a valve spring of an internal combustion engine. The spring plate can be connected directly to the valve stem of a charge changing valve while engaging an annular groove in the valve stem. An annular disc is arranged on the valve spring and two supporting tongues which are directed radially inwardly from the annular disc and whose inner ends, in a plan view of the spring plate, comprise recesses for engaging an annular groove. An assembly consisting of a charge changing valve of an internal combustion engine with a valve stem has an annular groove and a spring plate for a valve spring. The spring plate is directly connected to the valve stem while engaging the annular groove. The spring plate is provided with an annular disc for being arranged on the valve spring and with two supporting tongues which are directed radially inwardly from the annular disc and whose inner ends, in a plan view of the annular disc, comprise recesses for engaging the annular groove. By providing only two supporting tongues it is possible to stiffen the spring plate without substantially increasing its mass. Furthermore, the production of the spring plate is simplified and it becomes easier to fit it to the charge changing valve.

DESCRIPTION OF A FIRST PREFERRED EMBODIMENT

According to a first preferred embodiment, the supporting tongues are arranged in such a way that, if the annular disc is axially supported from the valve spring end and if the supporting tongues are axially loaded towards the valve spring end, the distance or space between the inner ends of the opposed supporting tongues is reduced. More particularly, when the spring plate is untensioned, a plan view of the spring plate shows a distance or space between the ends of the supporting tongues. This results in an assembly which is characterised in that the supporting tongues are designed in such a way that if the annular disc is axially supported by the valve spring and if the supporting tongues are axially loaded by an annular flank in the annular groove towards the valve spring end, the distance or space between the inner ends of the radially opposed supporting tongues is reduced. Thus, when the assembly is subjected to loads when in operation, with an increasing spring force, the radially directed supporting force of the spring plate at the valve stem inside the annular groove is increased by pressing down the valve stem, so that there is achieved a stiff connection and the supporting tongues are prevented from bending over.

DESCRIPTION OF THE SECOND PREFERRED EMBODIMENT

According to a second preferred embodiment, the supporting tongues are designed in such a way that, if the annular disc is axially supported from the valve spring end and if the supporting tongues are axially loaded towards the valve spring end, the distance or space between the inner ends of the opposed supporting tongues remains unchanged. More particularly, when the spring plate is in the mounted condition, the inner ends of the supporting tongues touchingly contact one another in an untensioned condition or under pretension. This measure results in an assembly wherein the supporting tongues are designed in such a way that, if the annular disc is axially supported by the valve spring and if the supporting tongues are axially loaded by an annular flank in the annular groove towards the valve spring end, the distance or space between the inner ends of the opposed supporting tongues remains unchanged. Thus, when the assembly is subjected to loads under operational conditions, with an increasing spring force, the radial supporting force of the inner ends of the supporting tongues relative to one another is increased by pressing down the valve stem, so that the spring plate is stiffened, it becomes impossible for the supporting tongues to be bent over. As a result of the radial play of the receiving aperture formed by the recesses relative to the annular groove, the spring plate, in an advantageous way, remains freely rotatable relative to the valve stem.

Furthermore, according to a preferred embodiment, it is proposed that, relative to a support line for the valve spring at the annular disc, the inner annular edges of the supporting tongues are axially spaced towards the end of the valve stem. Furthermore, it is proposed that the straight lines through the inner annular edges of the supporting tongues and the support line for the valve spring at the annular disc enclose an obtuse angle which opens towards the valve spring.

Embodiments with preferred designs wherein an axial section through the spring plate, centrally through the supporting tongues, shows one annular disc half with one supporting tongue extending in an S-shaped or Z-shaped way. According to a preferred embodiment of the spring plate, between the supporting tongues and the annular disc, there are formed two opposed sickle-shaped broken-away portions laterally relative to the supporting tongues.

ADDITIONAL EMBODIMENTS

According to a further embodiment, in a plan view of the spring plate, the recesses at the inner ends of the supporting tongues complement one another to form a circle. As an alternative, in a plan view of the spring plate shows that the recesses at the inner ends of the supporting tongues complement one another to form an oval whose shorter inner dimension extends towards the supporting tongues. In the first alternative, there is advantageously achieved a substantially uniform edge load. In the second alternative the spring plate may slightly tilt to allow self-alignment on the valve stem and to allow adaptation to the valve spring.

Thus the invention consists in providing a device for mounting an above-mentioned assembly composed of a spring plate and a charge changing valve, having supporting means on which the spring plate is able to rest by means of the upper side of the annular disc. Tension means are positioned inside the supporting means and are axially adjustable relative to the supporting means, and have a pair of tension claws that can be actuated by the tension means and which are radially movable relative to the supporting means and the tension means. The tension claws, in a radially outwardly pivoted position, can be guided through the sickle-shaped broken-out portions of the spring plate and the tension claws, in a radially inwardly pivoted position, engage behind the supporting tongues from the valve spring end.

One embodiment consists in an assembly device having an outer supporting sleeve on whose circular first sleeve end the spring plate is able to rest by means of the upper side of the annular disc. An inner tension sleeve which can be drawn into the supporting sleeve comprises two tension claws which can be bent radially outwardly. In the position in which they are moved out of the supporting sleeve, the claws can bend radially outwardly and can be guided through the sickle-shaped broken-out portions of the spring plate. When the tension sleeve is pulled back into the supporting sleeve, the claws pivot inwardly and rest on the underside of the supporting tongues and bend same outwardly while widening the insertion aperture, so that the valve stem can be introduced into the spring plate from the valve spring end.

A simple type of actuating means can consist of a tension sleeve having an outer thread on to which there is threaded a nut which is supported on the supporting sleeve at the axially opposite end relative to the annular first sleeve end, on the second sleeve end.

For mass production purposes it is preferable for the tension sleeve to comprise axial adjusting means which are supported relative to the supporting sleeve and which are adjustable, more particularly hydraulically, pneumatically, electrically or electro-magnetically.

Another embodiment concerns an assembly device with a housing having outer supporting tongues on whose ends the spring plate is able to rest by means of the upper side of the annular disc, having an inner tension pin which can be drawn in between the supporting tongues and two radially outwardly pivotable tension claws. In the position in which they are moved out of the supporting tongues, they can be pivoted radially outwardly and can be guided through the sickle-shaped broken-out portions of the spring plate. When the tension pin is pulled back, they pivot inwardly between the supporting tongues and rest on the underside of the supporting tongues and bend same outwardly while widening the insertion aperture, so that the valve stem can be introduced into the spring plate from the valve spring end.

More particularly, it is proposed that the tension claws are arranged between two guiding jaws which are arranged crosswise relative to the supporting tongues.

For this assembly device, too, it is proposed that the tension pin comprises axial adjusting means which are indirectly supported relative to the supporting tongues and which are adjustable, more particularly hydraulically, pneumatically, electrically or electro-magnetically.

The preferred method of producing the inventive spring plate first includes the drawing and punching of the product out of an annular disc or a circular blank. This operation is followed by a heat treatment, subsequent shot-blasting and grinding at least of the end face to permit arrangement in the annular groove and of the inner edges which form the insertion aperture.

BRIEF DESCRIPTION OF THE DRAWINGS

Preferred embodiments of the invention and of the inventive devices for assembling same are illustrated in the drawings and will be described below.

a) in an isometric illustration
b) in an axial view with a superimposed spring plate
c) in a longitudinal section along line A-A of illustration b
d) an axial view of the opposite end of the device.

Figure 6:
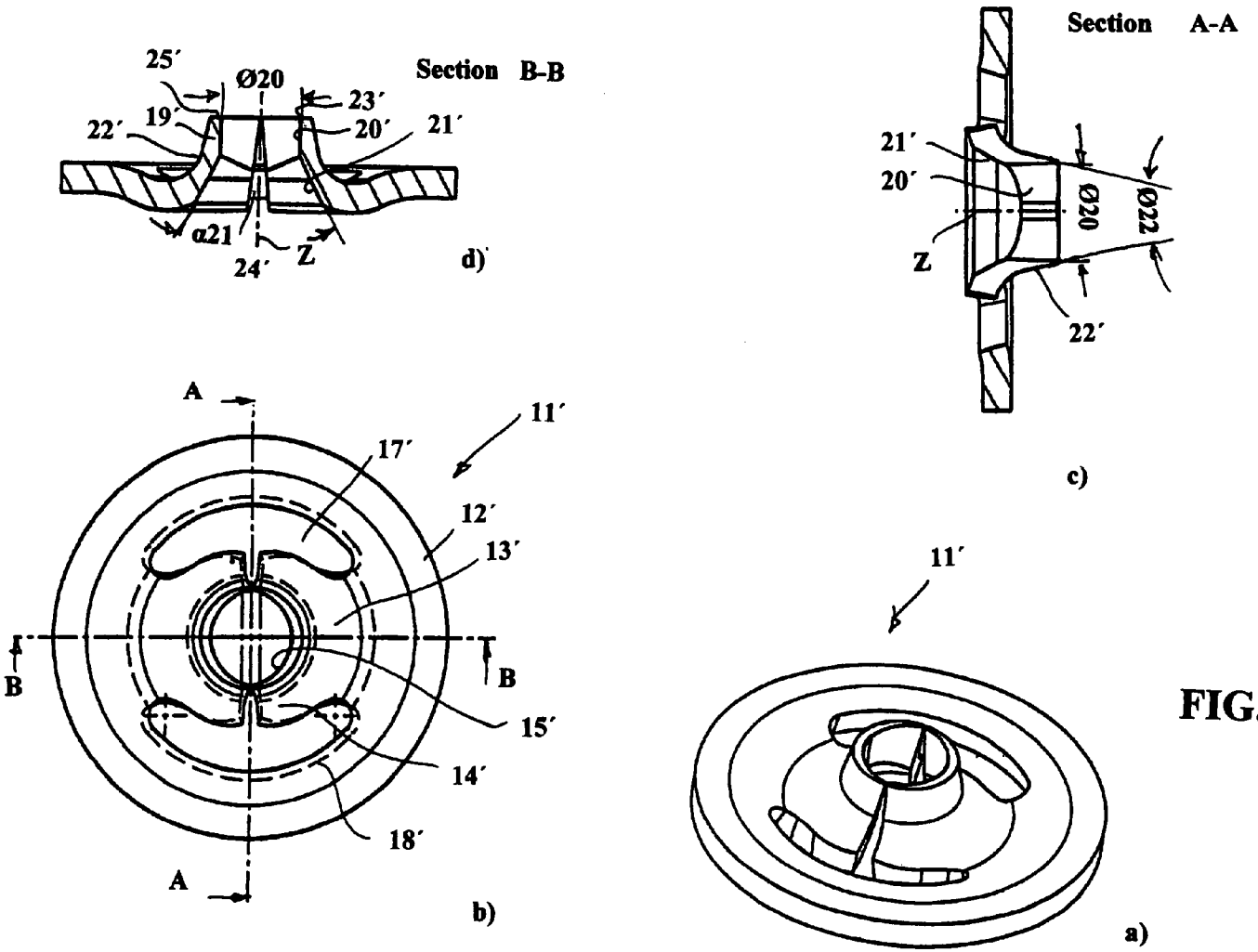

FIG. 6 illustrates an inventive spring plate in a second embodiment a) in an isometric illustration
b) in a plan view
c) in a section along line A-A according to illustration b
d) in a section along line B-B according to illustration b.

Figure 7:
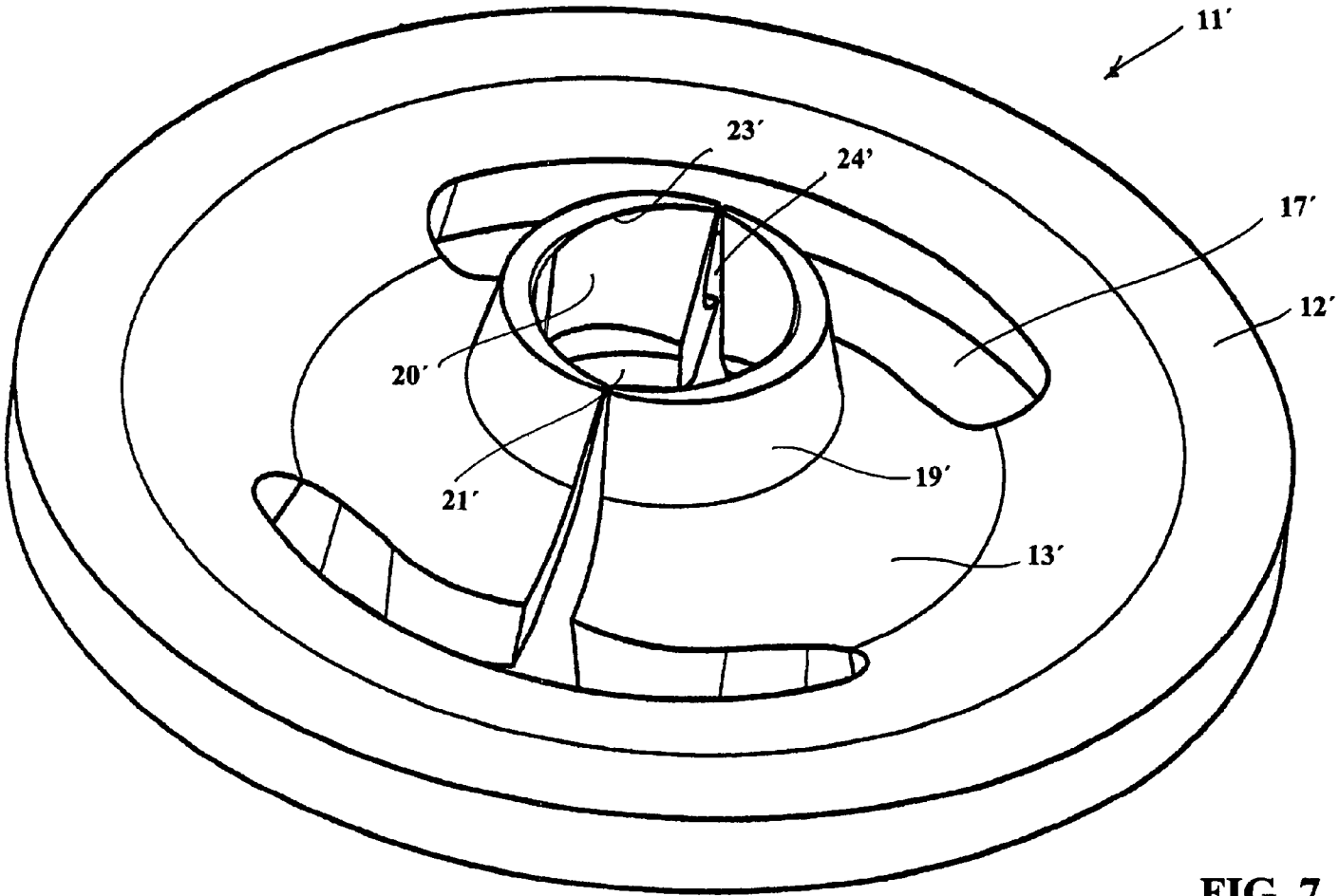

FIG. 7 illustrates a spring plate according to FIG. 6*a* in an enlarged illustration with reference numbers.

Figure 8:
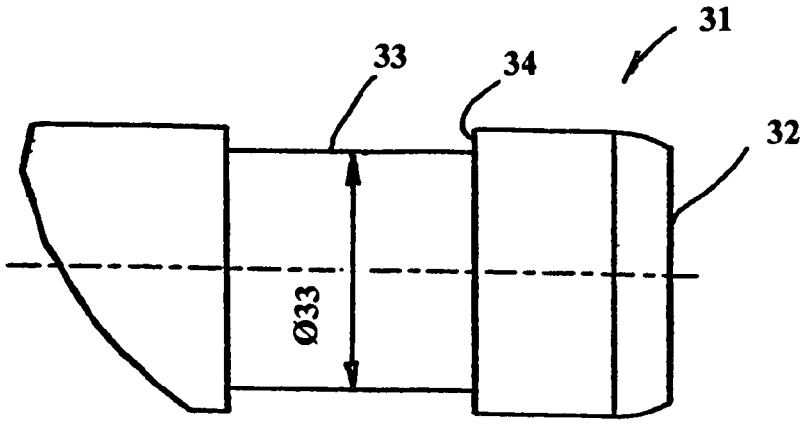

FIG. 8 illustrates the end of a valve stem of a charge changing valve to be connected to the inventive spring plate according to FIG. 6.

Figure 9:
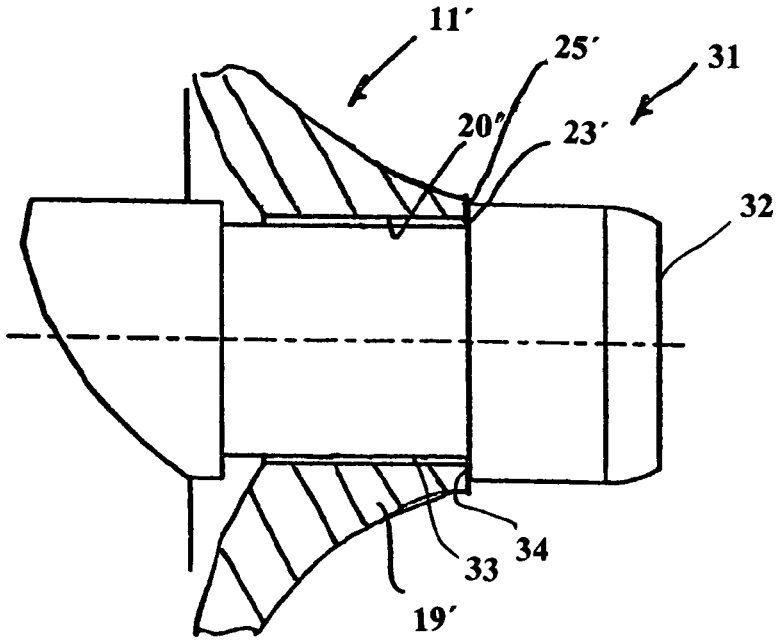

FIG. 9 illustrates an inventive assembly consisting of a spring plate according to FIG. 6 and the valve stem of a charge changing valve.

Figure 10:
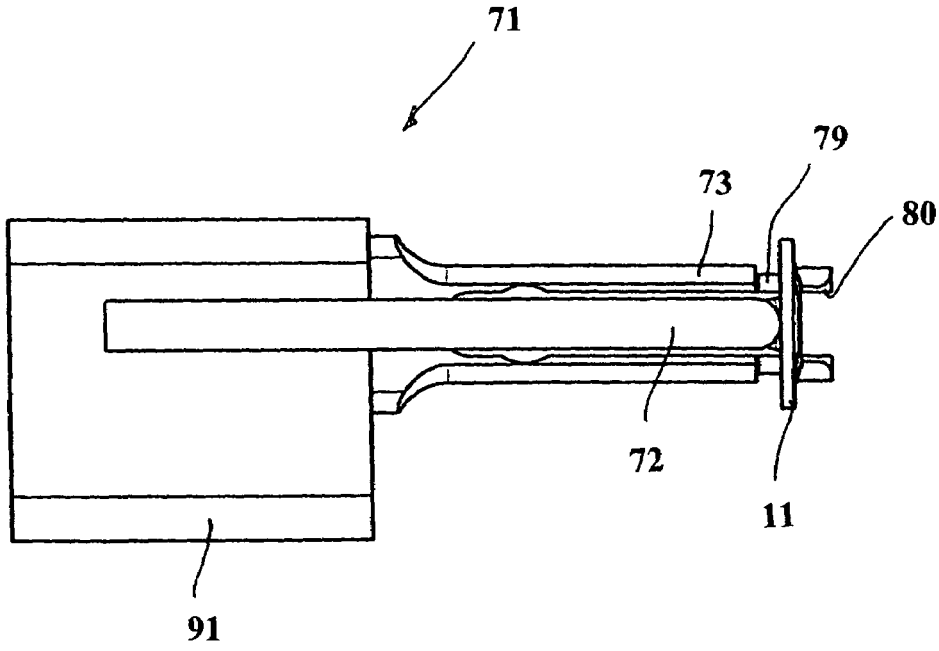

FIG. 10 illustrates an inventive device for mounting an inventive assembly in a second embodiment with an inserted spring plate in a side view.

Figure 11:
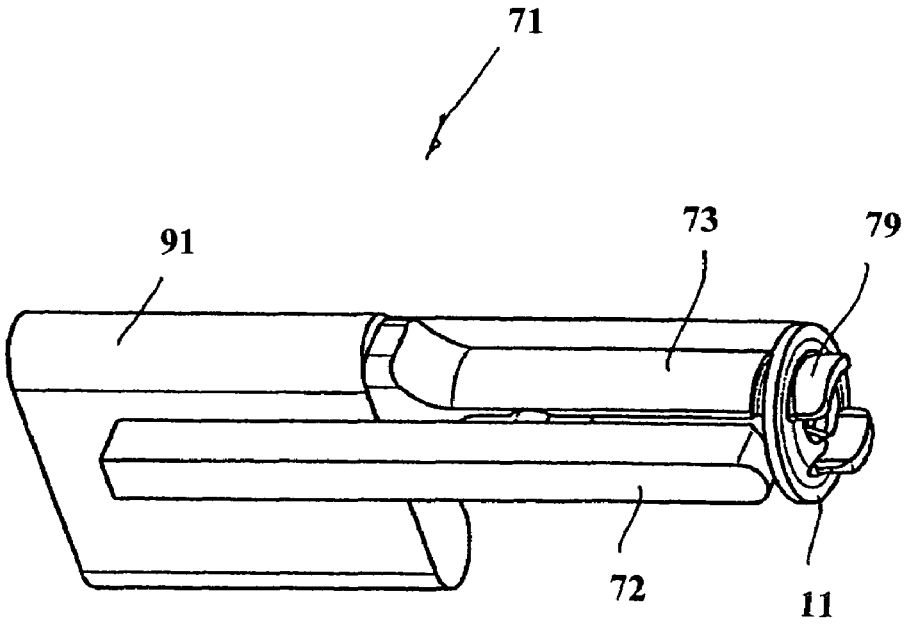

FIG. 11 illustrates the device according to FIG. 10 in an isometric illustration.

Figure 12:
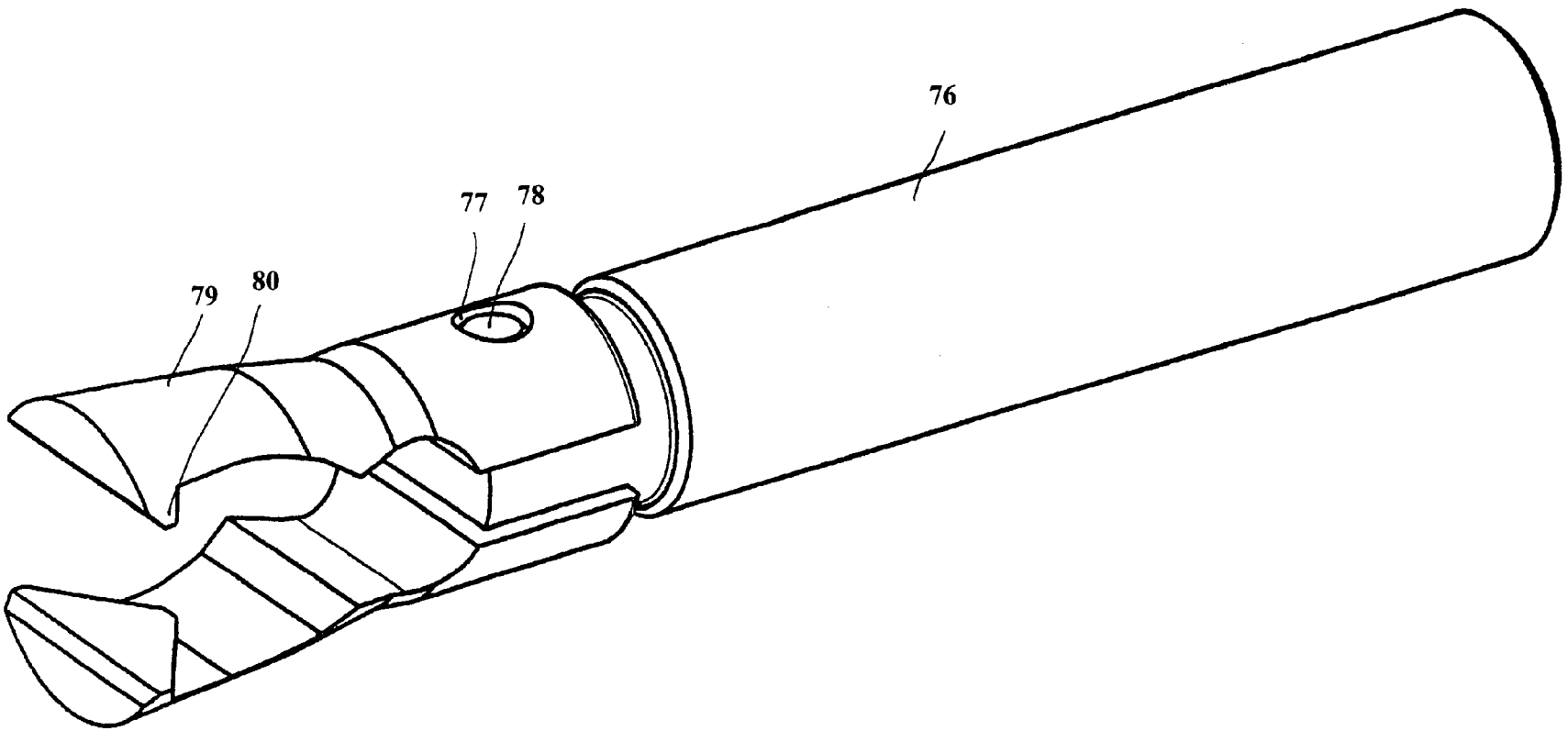

FIG. 12 illustrates details of the device according to FIGS. 10 and 11 in an isometric illustration.

DETAILED DESCRIPTION OF THE INVENTION

Figure 1:
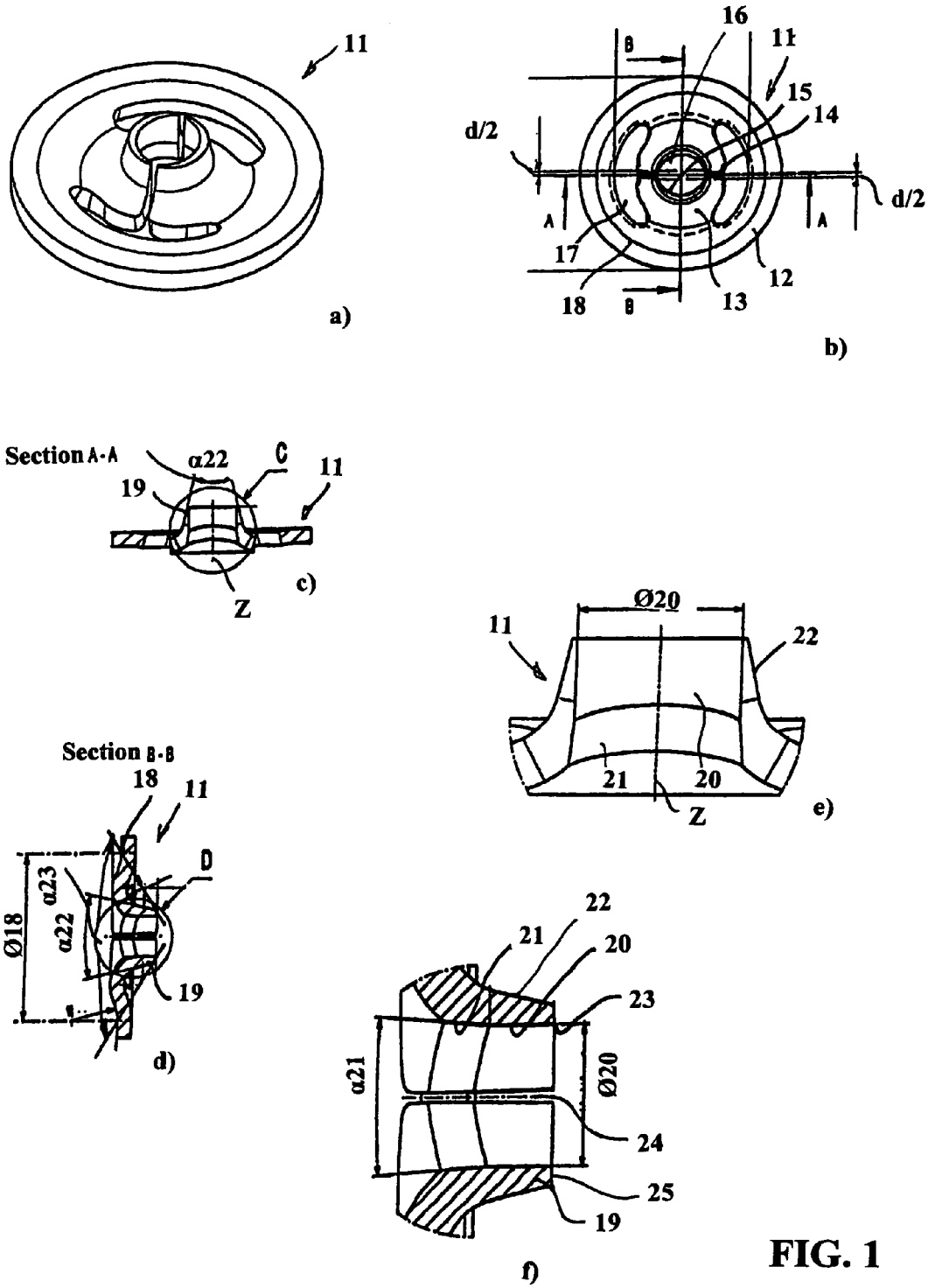
FIG. 1 illustrates an inventive spring plate of a first embodiment a) in an isometric illustration
b) in a plan view
c) in a section along line A-A according to illustration b
d) in a section along line B-B according to illustration b
e) in an enlarged detail of illustration c
f) in an enlarged detail of illustration d.
Figure 2:
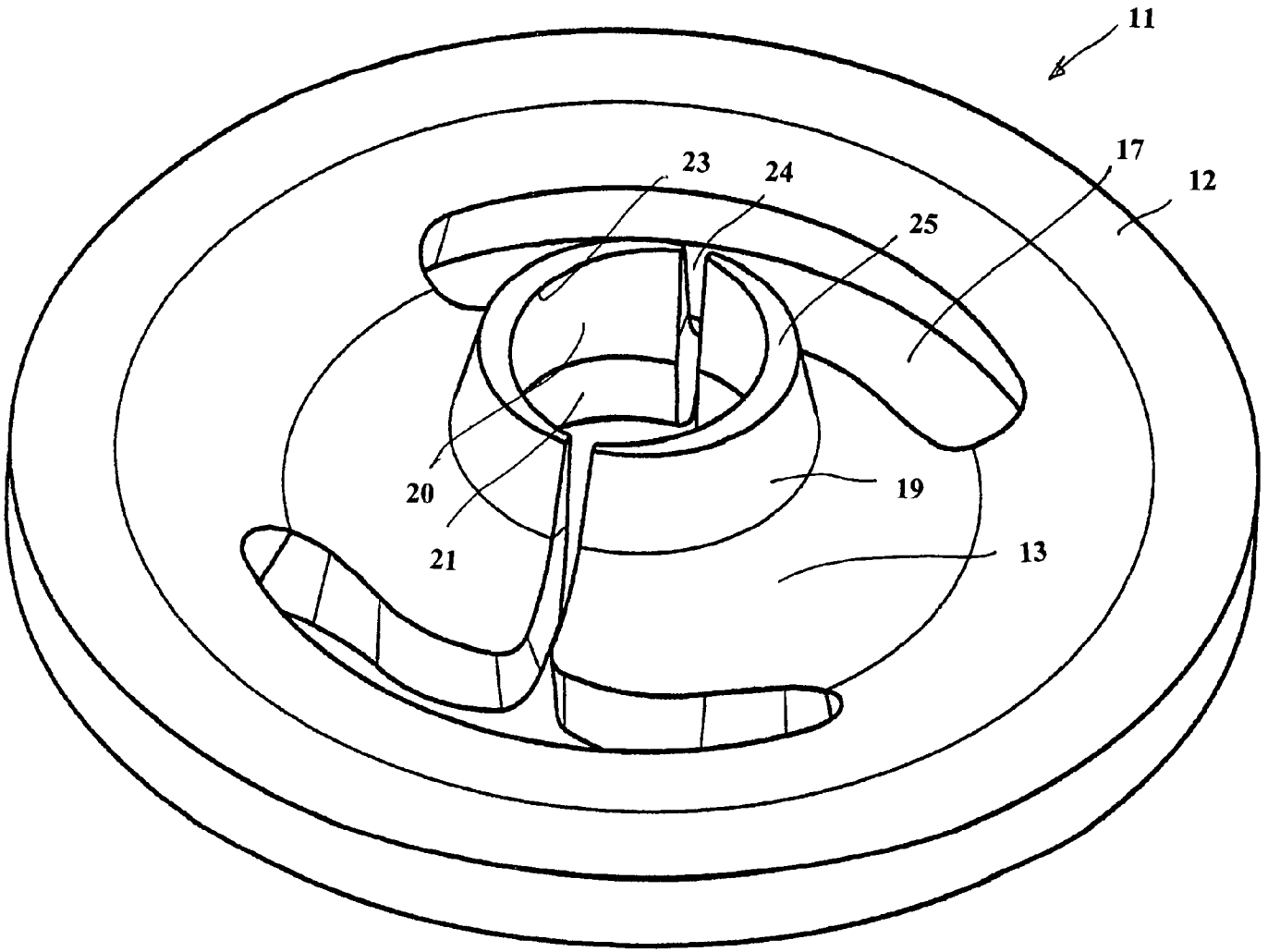
FIG. 2 illustrates a spring plate according to FIG. 1*a* in an enlarged illustration with reference numbers.

The individual illustrations of FIGS. 1 and 2 will be described jointly below. The inventive spring plate 11 is shown to comprise an outer annular disc 12 and two supporting tongues 13 radially projecting inwardly from the annular disc 12. In accordance with the invention, the number of supporting tongues 13 is limited to two. The spring plate 11 as a whole and more particularly the supporting tongues 13 extend symmetrically relative to a sectional plane A-A through the central axis Z of the spring plate 11. In the tension-free position of the spring plate 11 as shown here, the inner ends 14 of the supporting tongues 13 are arranged at a distance or space d from one another in the direction of the sectional plane B-B. The front ends 14 of the supporting tongues 13 comprise approximately semi-circular recesses 15 which, jointly, form an insertion aperture 16. The recesses 15 allow the supporting tongues to be axially and radially supported in an annular groove of a valve stem of a charge changing valve of an internal combustion engine while engaging the annular groove. The shape of the recesses 15 is such that they can complement one another to form a circle or an oval whose greater axis extends in the direction of the sectional plane A-A.

In principle, the insertion aperture 16 formed by the recesses 15, in a plan view, can also have the shape of a polygon which describes the above-described curves or oval. The supporting tongues 13 are designed in such a way that two opposed sickle-shaped broken-out portions 17 are formed between the supporting tongues 13 and the annular disc 12. The support line 18 for a valve spring on the annular disc 12 is characterised by a circular line. The diameter Ø18 of the support line 18 corresponds to the mean winding diameter of the associated helical spring plate in the illustration of the plan view according to FIG. 1*b*. It is thus possible to see the upper side of the spring plate which rests on the valve spring by means of its underside (not shown). In the region of the inner ends 14, the supporting tongues 13 have been shaped to form a centrally divided supporting sleeve 19 which, between the supporting tongues 13, forms two slots 24 with a constant width (d). The material of the complete spring plate 11 comprises a substantially constant wall thickness, but is reduced in the region of the supporting sleeve 19.

The insertion aperture 16 is formed of an inner cylindrical portion 20 with a diameter Ø20 and of an inner conical portion 21 with an acute opening angle α21. The opening angle α21 can preferably range between 5-10°, more particularly amounting to 8.5°. The wall thickness of the supporting sleeve 19 is reduced, more particularly towards the free end of the supporting sleeve 19, with an outer conical face 22 forming a greater opening angle α22 than the inner conical portion 21, with the opening angle α22 preferably ranging between 20-30°, more particularly amounting to 26°. It can be seen in section B-B that, in the section through the supporting tongues 13, the spring plate halves are curved in an S-shaped way and change approximately tangentially into the supporting sleeve 19. By means of an in inner supporting edge 23 at the end face 25 at the free end of the supporting sleeve 19 the spring plate 11 is supported in an annular groove at the valve stem while being loaded by the valve spring. Straight lines through the support line 18 on the underside of the spring plate and through the supporting edge 23, which are also shown in the drawing, enclose an obtuse angle α23 which opens towards the valve spring end.

Expressed in a different way, this means that there exists an axial distance or space between the support line 18 on the spring plate underside and the supporting edge 23 which comprises a smaller diameter than the support line 18. Thus if the spring plate 11 is loaded by the valve spring on the one hand, which load acts on the annular disc 12, and loaded by the valve stem on the other hand, which valve stem acts on the supporting tongues 13 by an annular groove, there is achieved an infinitesimal deformation of the supporting tongues which has the tendency of reducing the width of the slots 24, so that the supporting sleeve 19 rests on the groove base of the annular groove in the valve stem with an increased radial pretension. The effective bending movements of the supporting tongues 13 are extremely slight because, after assembly, the supporting tongues 13 are already positioned in a play-free way, more particularly with a radial pretension, in the annular groove of the valve stem.

Figure 3:
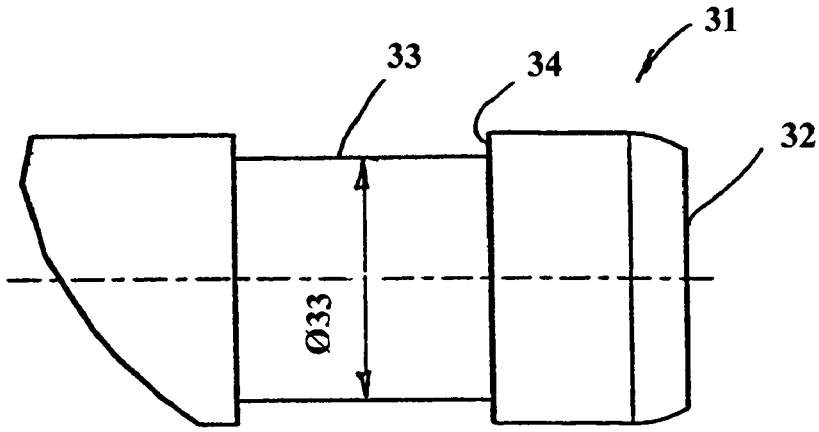
FIG. 3 illustrates the end of a valve stem of a charge changing valve to be connected to an inventive spring plate according to FIG. 1.
Figure 4:
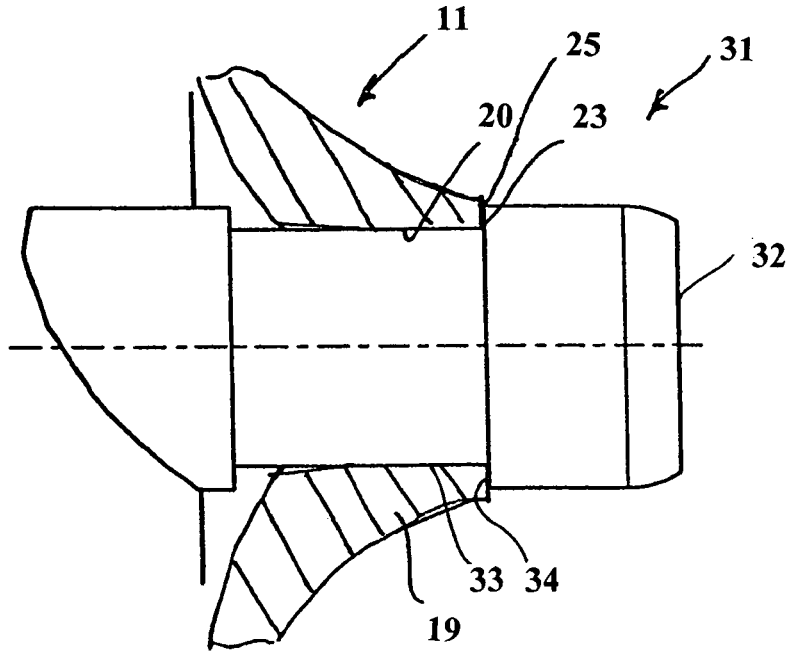
FIG. 4 illustrates an inventive assembly consisting of a spring plate according to FIG. 1 and of the valve stem of a charge changing valve.

FIGS. 3 and 4 will now be described jointly below. They show the broken-off valve stem 31 of a charge changing valve where, at a short distance or space from a pressure face 32 for a cam or the like, there is formed an annular groove 33 in a rectangular shape whose groove base comprises the diameter Ø33. The diameter Ø33 is greater than the diameter Ø20 of the cylindrical portion 20 of the supporting sleeve 19 of the spring plate 11 in the untensioned condition. In FIG. 3, the spring plate 11 is mounted in the annular groove 33, and by means of its supporting edge 23 and its end face 25 respectively. It is supported on an annular flank 34 of the annular groove 33 by means of the cylindrical portion 20 of the supporting sleeve 19 while it rests under pretension on the base of the annular groove 33.

Figure 5:
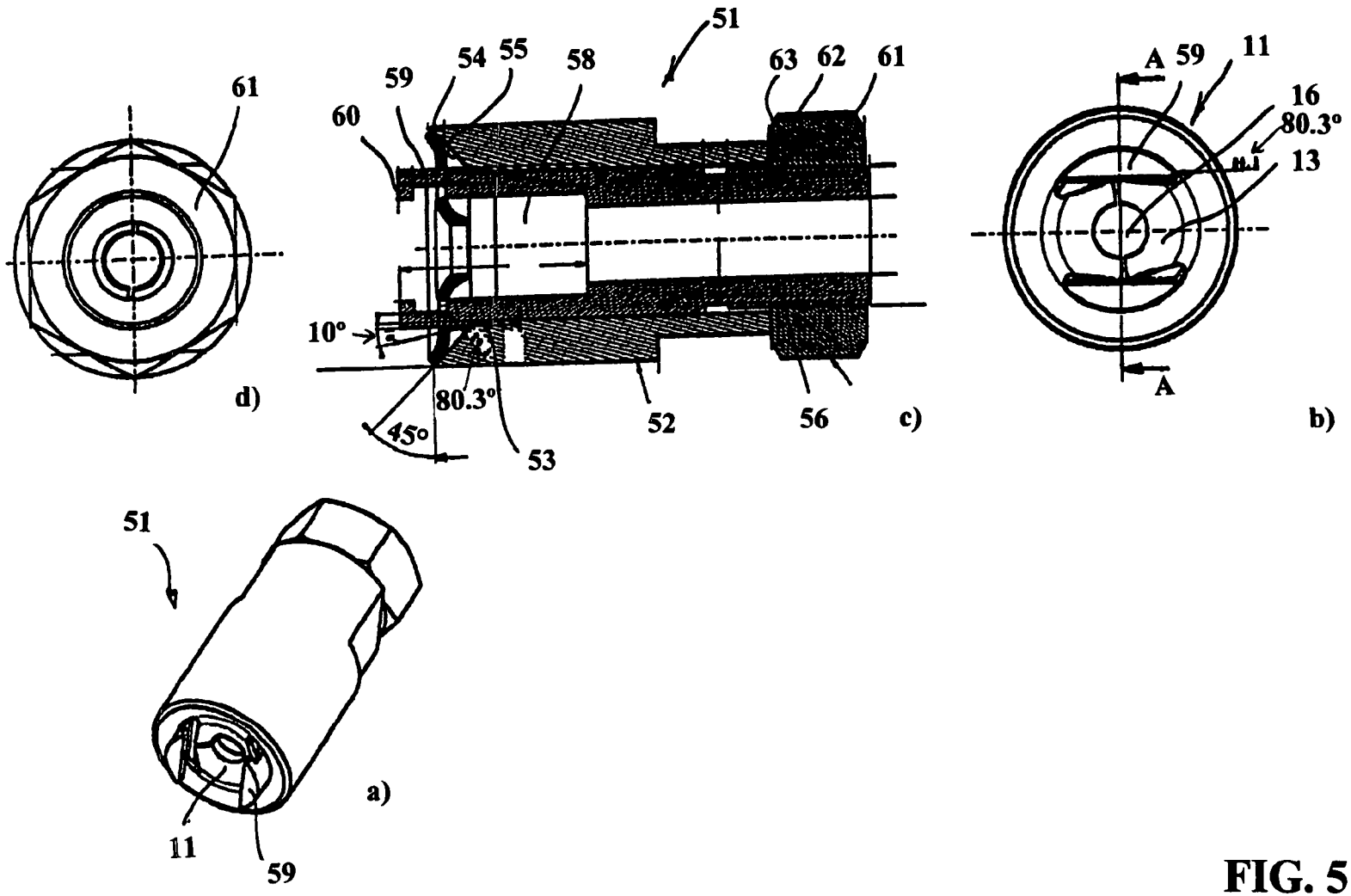
FIG. 5 illustrates an inventive device for mounting an inventive assembly in a first embodiment.

The individual illustrations of FIG. 5 will be described jointly below. The inventive assembly device 51 comprises an outer supporting sleeve 52 with an inner cone 53 at a first sleeve end 54 positioned on the left in illustration c. A tension sleeve 56 is axially displaceably inserted into the supporting sleeve 52. At the tension sleeve 56 there is formed an outer cone 57 which can cooperate with the inner cone 53 when the tension sleeve 56 is displaced inside the supporting sleeve 52 in illustration c towards the right. The front end of the tension sleeve 56 comprises a central trough-like recess 58 which serves to form two opposed claws 59 with inwardly pointing hooks 60. Furthermore, the tension sleeve 56 comprises an outer thread 61 on to which there is threaded a nut 62 which is supported on the second sleeve end 63 of the supporting sleeve 52 positioned on the right. In the longitudinal section of illustration c, the tension sleeve 56 is shown in a position displaced towards the left, in which position the claws 59 with the hooks 60 can be guided through the broken-out portions 17 of an inventive spring plate 11 (See FIG. 2) placed on to the first sleeve end 54.

If, starting from this position, the tension sleeve 56 is displaced relative to the supporting sleeve 52 by tightening the nut 62 towards the right, the outer cone 57 slides on to the inner cone 53, so that the claws 59 bend inwardly in an elastically pretensioned condition. The hooks 60 radially overlap with the lateral edges of the supporting tongues 13, so that the latter are bent open, with the insertion aperture 16 being widened. The deformation continues until the valve stem of a charge changing valve, with its entire diameter, can be pushed through the insertion aperture 16 until the annular groove in the valve stem reaches the axial position of the supporting tongues 13 and until, by loosening the nut 62, it becomes possible for the supporting tongues 13 to engage by means of their inner ends 14 the annular groove in the valve stem. In the untensioned position of the claws 59, the assembly device 51 can be removed from the assembly consisting of the valve stem and the spring plate. The thread/nut combination for generating the tension forces on the tension sleeve can be replaced by any other suitable means generating axial forces. Such means can be operated hydraulically or pneumatically or also electro-magnetically or electrically.

The individual illustrations of FIGS. 6 and 7 will be described jointly below. The inventive spring plate 11' is shown to comprise an outer annular disc 12' and two supporting tongues 13' radially projecting inwardly from the annular disc 12'. The number of supporting tongues 13' in this embodiment is limited to two. The spring plate 11' as a whole and more particularly the supporting tongues 13' extend symmetrically relative to a sectional plane A-A through the central axis Z of the spring plate 11'. In the position of the spring plate 11' as shown here, the inner ends 14' of the supporting tongues 13' are positioned in the sectional plane A-A in an untensioned condition or they support one another with a compressive pretension so as to touchingly contact one another. The front ends 14' of the supporting tongues 13' comprise recesses 15' which form an insertion aperture 16'. By means of the recesses 15', the supporting tongues 13' are able to axially support one another in an annular groove of a valve stem of a charge changing valve of an internal combustion engine while engaging the annular groove. The shape of the recesses 15' is such that they can complement one another to form a circle or an oval whose greater axis extends in the direction of the sectional plane A-A.

In principle, the insertion aperture 16' formed by the recesses 15', in a plan view, can also have the shape of a polygon which describes the above-described curves (circle or oval). The supporting tongues 13' are designed in such a way that two opposed sickle-shaped broken-out portions 17' are formed between the supporting tongues 13' and the annular disc 12'. The support line 18 for a valve spring on the annular disc 12' is characterised by a circular line. The diameter Ø18 of the support line 18 corresponds to the mean winding diameter of an associated helical spring plate. The predetermined position of the valve spring is to be assumed to be underneath the spring plate in the illustration of the plan view according to FIG. 6*b*. It is therefore possible to see the upper side of the spring plate which, by means of its underside, rests on the valve spring which is not shown. In the region of the inner ends 14', the supporting tongues 13' have been deformed to form a centrally divided supporting sleeve 19' which, between the supporting tongues 13', forms two slots 24' which are wedge-shaped. The material of the complete spring plate 11 comprises a substantially constant wall thickness, but is reduced in the region of the supporting sleeve 19'. The insertion aperture 16' is formed of an inner cylindrical portion 20' with a diameter Ø20 and of an inner conical portion 21' with an acute opening angle α21'. The opening angle α21' can preferably range between 40-60° and more particularly 50°. The wall thickness of the supporting sleeve 19' is reduced, more particularly towards the free end of the supporting sleeve 19', with an outer conical face 22 forming an opening angle α22 which preferably ranges between 20-30° and more particularly 26°.

It can be seen in section B-B that, in the section-through the supporting tongues 13', the spring plate halves are curved in an S-shaped way and change approximately tangentially into the supporting sleeve 19'. By means of an end face 25', more particularly by means of an inner supporting edge 23' at the free end of the supporting sleeve 19', the spring plate 11' is supported in an annular groove at the valve stem while being loaded by the valve spring. Straight lines through the support line 18' on the underside of the spring plate and through the supporting edge 23', which are also shown in the drawing, enclose an obtuse angle α23' which opens towards the valve spring end. Expressed in a different way, this means that there exists an axial distance or space between the support line 18' on the spring plate underside and the supporting edge 23 which comprises a smaller diameter than the support line 18'. If the spring plate 11' is loaded by the valve spring on the one hand, the load acts on the annular disc 12' and is loaded by the valve stem on the other hand. The valve stem acts on the supporting tongues 13' by an annular groove and there is achieved an infinitesimal deformation of the supporting tongues 13' which has the tendency of widening the wedge-like shape of the slots 24', so that the supporting sleeve 19' axially rests on the annular flank 34 of the annular groove 33 in the valve stem with an increased radial pretension. The effective bending movements of the supporting tongues 13' are extremely sight because, after assembly, the supporting tongues 13' already rest against one another in a play-free way, more particularly with a radial pretension, with the supporting sleeve 19' being positioned with radial play in the annular groove of the valve stem.

FIGS. 8 and 9 will now be described jointly below. They show the broken-off valve stem 31' of a charge changing valve in which, at a short distance or space from a pressure face 32' for a cam or the like, there is formed an annular groove 33' in a rectangular shape whose groove base comprises the diameter Ø33'. The diameter Ø33' is smaller than the diameter Ø20' of the cylindrical portion 20' of the supporting sleeve 19' of the spring plate 11' in the untensioned condition. In FIG. 9, the spring plate 11' is mounted in the annular groove 33', and by means of its supporting edge 23' and its end face 25' respectively it is supported on an annular flank 34' of the annular groove 33'. The supporting sleeve 19' has radial play relative to the groove base of the annular groove 33', so that the spring plate 11', together with the valve spring (not illustrated) is able to freely rotate relative to the valve stem 31 of the charge changing valve.

FIGS. 10 and 11 will be described jointly below. An inventive assembly device 71 comprises a housing 91 with two outer supporting tongues 72. Two opposed guiding jaws 73 are offset by 90° relative to the supporting tongues 72. Into the housing 91 there is axially displaceably inserted a tension pin at which two claws 79 are articulated. In a first position, the tension pin in the housing is displaced towards the right, with the claws 79 being untensioned and being pivoted outwardly. The claws 79 with hooks 80 can be guided through the broken-out portions 17 of an inventive spring plate 11 placed on to the supporting tongues. If, starting from this position, the tension pin in the housing 91 is displaced towards the left, the claws 79 pivot inwardly. The hooks 80 radially overlap the lateral edges of the supporting tongues 13, so that the latter are bent open, with the insertion aperture 16 being widened. The deformation continues until the valve stem of a charge changing valve, with its entire diameter, can be pushed through the insertion aperture 16 until the annular groove in the valve stem reaches the axial position of the supporting tongues 13 and until, by pushing forward the tension pin, it becomes possible for the supporting tongues 13, by means of their inner ends 14, to engage the annular groove at the valve stem. In the untensioned condition of the claws 79, the device 71 can be removed from the assembly consisting of the valve stem and the spring plate. For generating the tensile forces on the tension pin, any suitable devices generating axial forces can be used. They can be operated hydraulically or pneumatically or electro-magnetically or electrically.

FIG. 12 shows a tension pin 76 with two articulated claws 79 in the form of an assembly. Articulation is achieved by bearing eyes 77 in the claws 79 which are positioned on a journal 78 inserted transversely through the tension pin. The claws 79 have inwardly directed hooks 80 and, by means of their outside, are guided by the guiding jaws. In an advanced position of the tension pin 76, the claws 79, by means of their free ends, are able to pivot radially outwardly. To effect the pivot movements of the claws 79, the outer conical portions at the claws can cooperate with inner conical portions in the guiding jaws.

The invention claimed is:

1. A spring plate for a valve spring of an internal combustion engine, which spring plate can be connected directly to the valve stem of a charge changing valve while engaging an annular groove in said valve stem, an annular disc arranged on said valve spring and having two supporting tongues which are directed radially inwardly from said annular disc and whose inner ends have recesses for engaging said annular groove, wherein in a plan view of said spring plate, said recesses at said inner ends of the supporting tongues complement one another to form an oval whose shorter inner dimension extends towards said supporting tongues.

2. A spring plate according to claim 1, wherein said annular disc is axially supported from the valve spring end and said supporting tongues are axially loaded towards the valve spring end so that the distance between the inner ends of the opposed supporting tongues is reduced.

3. A spring plate according to claim 2, wherein said spring plate is untensioned, with a space between the inner ends of the supporting tongues.

4. A spring plate according to claim 1, wherein said the annular disc is axially supported from the valve spring end and the supporting tongues are axially loaded towards the valve spring end so that the space between the inner ends of the opposed supporting tongues remains unchanged.

5. A spring plate according to claim 4, wherein where said spring plate is removed, said inner ends of the said supporting tongues are in touchingly contact with one another in an untensioned condition and when under pretension.

6. A spring plate according to claim 1, wherein said inner ends of said supporting tongues are formed into a supporting sleeve divided by slots.

7. A spring plate according to claim 1, wherein relative to a support line for said valve spring at said annular disc, inner supporting edges of said supporting tongues are axially spaced towards the end of the valve stem.

8. A spring plate according to claim 1, wherein straight lines through the inner supporting edges of said supporting tongues and a support line for the valve spring at the annular disc enclose an obtuse angle which opens towards the valve spring.

9. A spring plate according to claim 1, wherein an axial section through said spring plate and centrally through said supporting tongues has one annular disc half with a supporting tongue, each of said supporting tongues extending in an S-shaped or Z-shaped way.

10. A spring plate according to claim 1, wherein in a plan view of said spring plate, between said supporting tongues and said annular disc, there are formed two opposed sickle-shaped broken-away portions laterally relative to the supporting tongues.

11. An assembly consisting of a charge changing valve of an internal combustion engine having a valve stem with an annular groove and a spring plate for a valve spring, wherein said spring plate is directly connected to said valve stem while engaging said annular groove and wherein said spring plate is provided with an annular disc arranged on said valve spring and having two supporting tongues which are directed radially inwardly from said annular disc and whose inner ends, in a plan view of the annular disc, comprise recesses for engaging the annular groove, wherein in a plan view of said spring plate, said recesses at said inner ends of the supporting tongues complement one another to form an oval whose shorter inner dimension extends towards the supporting tongues.

12. An assembly according to claim 11, wherein said annular disc is axially supported by the valve spring and said supporting tongues are axially loaded by an annular flank in said annular groove towards the valve spring end, the distance between said inner ends of the said radially opposed supporting tongues is reduced.

13. An assembly according to claim 12, wherein, in a plan view, said spring plate is with a space between said inner ends of said supporting tongues and when said recesses engage said annular groove in a play-free way, and with pretension.

14. An assembly according to claim 11, wherein said annular disc is axially supported by said valve spring said supporting tongues are axially loaded by an annular flank in said annular groove towards the valve spring end, the space between said inner ends of said opposed supporting tongues remains unchanged.

15. An assembly according to claim 14, wherein with said spring plate is in the mounted condition, said inner ends of said supporting tongues touchingly contact one another in an untensioned condition or under pretension and said recesses engage said radial groove with radial play.

16. A device according to claim 15, having an outer supporting sleeve on whose first sleeve end said spring plate is able to rest by means of the upper side of said annular disc, and wherein an inner tension sleeve which can be drawn into said supporting sleeve and comprises two tension claws which can be bent radially outwardly and which, in the position in which they are moved out of said supporting sleeve, bend radially outwardly and are guided through sickle-shaped broken-out portions of said spring plate and which, when said tension sleeve is pulled back into said supporting sleeve, pivot inwardly and rest on the underside of said supporting tongues and bend same outwardly while widening are insertion aperture, so that a valve stem can be introduced into said spring plate from said valve spring end.

17. A device according to claim 16, wherein said tension sleeve comprises an outer thread on to which there is threaded a nut which is supported on said supporting sleeve at the axially opposite end relative to a first sleeve end, on a second sleeve end.

18. A device according to claim 16, wherein said tension. sleeve comprises an axial adjusting means which are supported relative to said supporting sleeve and which are adjustable, more particularly hydraulically, pneumatically, electrically and electro-magnetically.

19. A device according to claim 18, wherein tension claws are guided between two guiding jaws and arranged cross-wise relative to said supporting tongues.

20. An assembly according to claim 11, wherein said inner ends of said supporting tongues are formed into a supporting sleeve divided by slots.

21. An assembly according to claim 11, wherein inner supporting edges of said supporting tongues are axially spaced towards the end of said valve stem relative to a support line for the valve spring at said annular disc.

22. An assembly according to claim 11, wherein straight lines through inner supporting edges of said supporting tongues and a support line for the valve spring at said annular disc enclose an obtuse angle which opens towards said valve spring.

23. An assembly according to claim 11, wherein an axial section through said spring plate and centrally through said supporting tongues has an annular disc half with a supporting tongue extending in an S-shaped or Z-shaped way.

24. An assembly according to claim 11, wherein said annular groove is provided in the form of a rectangular groove.

25. An assembly according to claim 11, wherein said supporting tongues comprise radial end faces for contacting an annular flank of said annular groove.

26. An assembly according to claim 11, having a mounting device with supporting means on which said spring plate is able to rest by means of the upper side of said annular disc, having tension means which are positioned inside said supporting means and which are axially adjustable relative to said supporting means, and a pair of tension claws which can be actuated by the tension means and which are radially movable relative to said supporting means and said tension means, and wherein said tension claws, in a radially outwardly pivoted position, can be guided through sickle-shaped broken-out portions of said spring plate and wherein said tension claws, in a radially inwardly pivoted position, engage behind said supporting tongues from the valve spring end.

27. A device according to claim 26, having outer supporting tongues on whose ends said spring plate is able to rest by means of the upper side of said annular disc, having an inner tension pin which can be drawn in between said supporting tongues, and two radially outwardly pivotable tension claws which, in the position in which they are moved out of the supporting tongues, can be pivoted radially outwardly and can be guided through said sickle-shaped broken-out portions of said spring plate and which, when said tension pin is pulled back, pivot inwardly between said supporting tongues and rest on the underside of said supporting tongues and bend same outwardly while widening the insertion aperture, so that the valve stem can be introduced into said spring plate from the valve spring end.

28. A device according to claim 27, wherein said tension pin comprises axial adjusting means which are indirectly supported relative to said supporting tongues and which are adjustable, more particularly, hydraulically, pneumatically, electrically and electro-magnetically.

* * * * *